US008375635B2

(12) United States Patent
Hellinga et al.

(10) Patent No.: US 8,375,635 B2
(45) Date of Patent: Feb. 19, 2013

(54) APPARATUS FOR OPENING AND CLOSING OVERHEAD SECTIONAL DOORS

(76) Inventors: Richard Hellinga, Waterloo (CA); Michael Johnson, Toronto (CA)

( * ) Notice: Subject to any disclaimer, the term of this patent is extended or adjusted under 35 U.S.C. 154(b) by 643 days.

(21) Appl. No.: 12/548,054

(22) Filed: Aug. 26, 2009

(65) Prior Publication Data

US 2011/0047877 A1 Mar. 3, 2011

(51) Int. Cl.
*E05F 15/00* (2006.01)

(52) U.S. Cl. ..... 49/199; 49/197; 49/198; 49/200; 160/188; 160/189

(58) Field of Classification Search ..... 49/197, 49/199, 200, 139, 140, 198; 160/188, 189, 160/192, 193; 192/48.91, 52
See application file for complete search history.

(56) References Cited

U.S. PATENT DOCUMENTS 1,827,433 A 10/1931 Kendall
1,860,636 A 5/1932 Tibbetts
1,941,574 A 1/1934 Nichols
2,020,831 A 11/1935 Greegor
2,099,191 A 11/1937 Blodgett
2,314,015 A 3/1943 Parsons
2,318,328 A 5/1943 Nallinger
2,426,023 A 8/1947 Jeppesen et al.
2,444,148 A 6/1948 Warwick
2,703,236 A 3/1955 Verdier
2,742,280 A 4/1956 Wilcox
2,827,114 A * 3/1958 Stroup ..... 160/209
2,841,724 A 7/1958 Brown
2,882,044 A 4/1959 Ginte
3,038,535 A 6/1962 Stroup et al.
3,106,275 A 10/1963 Chambers
3,113,471 A 12/1963 Gregory
3,134,273 A 5/1964 Wardlaw
3,160,200 A * 12/1964 McKee et al. ..... 160/189
3,224,492 A 12/1965 Houk
3,311,159 A 3/1967 Stansberry
3,412,780 A 11/1968 Moler
3,470,653 A 10/1969 Kalog
3,512,302 A 5/1970 Sivin et al.
3,590,529 A 7/1971 Purdy
3,603,177 A 9/1971 Burrows
3,608,612 A 9/1971 Pemberton et al.
3,635,277 A 1/1972 Bahnsen
3,728,605 A 4/1973 Purtilo
3,764,874 A 10/1973 Geoffrey
3,764,875 A 10/1973 Harris
3,813,590 A 5/1974 Ellmore
3,899,726 A 8/1975 Ellmore
3,996,697 A 12/1976 Bailey et al.
(Continued)

*Primary Examiner* — Katherine W Mitchell
*Assistant Examiner* — Marcus Menezes
(74) *Attorney, Agent, or Firm* — Bereskin & Parr LLP

(57) ABSTRACT

An apparatus for opening and closing an overhead door, having a door assembly for mounting to the overhead door, and an operator for securely engaging the door assembly. The operator has a chassis, and a cable reel rotatably mounted to the chassis and coupled to a main cable. When the main cable is coupled to the door assembly, as the cable reel is rotated in a first direction, the door assembly is drawn towards the operator so as to close the door. The apparatus may include a latch assembly for securing the door assembly to the operator when the door is closed, and a latch release mechanism for selectively disengaging the latch assembly so as to disengage the door assembly from the operator. The overhead door may be biased so that when the latch assembly is disengaged, the overhead door automatically opens.

17 Claims, 7 Drawing Sheets

U.S. PATENT DOCUMENTS

| | | | | |
|---|---|---|---|---|
| 4,010,408 | A | 3/1977 | Bailey | |
| 4,047,441 | A | 9/1977 | Kellogg | |
| 4,085,629 | A | 4/1978 | Fogarollo | |
| 4,098,023 | A | 7/1978 | Slopa | |
| 4,167,833 | A | 9/1979 | Farina et al. | |
| 4,191,237 | A | 3/1980 | Voege | |
| 4,231,191 | A | 11/1980 | Ellmore | |
| 4,234,833 | A | 11/1980 | Barrett | |
| 4,300,660 | A | 11/1981 | Schoenmann et al. | |
| 4,311,225 | A | 1/1982 | Tsubaki et al. | |
| 4,394,607 | A | 7/1983 | Lemirande | |
| 4,408,146 | A | 10/1983 | Beckerman | |
| 4,443,033 | A | 4/1984 | D'Anna | |
| 4,460,030 | A | 7/1984 | Tsunemura et al. | |
| 4,464,651 | A | 8/1984 | Duhame | |
| 4,472,910 | A | 9/1984 | Iha | |
| 4,497,220 | A | 2/1985 | Grinde | |
| 4,511,832 | A | 4/1985 | Schmitz | |
| 4,519,487 | A | 5/1985 | Florin | |
| 4,538,661 | A | 9/1985 | Henry et al. | |
| 4,598,238 | A | 7/1986 | Scarano | |
| 4,611,504 | A | 9/1986 | Rundle | |
| 4,618,174 | A | 10/1986 | Duke | |
| 4,628,496 | A | 12/1986 | Lee | |
| 4,638,433 | A | 1/1987 | Schindler | |
| 4,684,225 | A | 8/1987 | Clark et al. | |
| 4,701,684 | A | 10/1987 | Seidel et al. | |
| 4,702,361 | A | 10/1987 | Banks | |
| 4,706,227 | A | 11/1987 | DuVall et al. | |
| 4,706,727 | A | 11/1987 | Leivenzon et al. | |
| 4,732,203 | A | 3/1988 | Alten | |
| 4,757,852 | A * | 7/1988 | Jentof et al. | 160/23.1 |
| 4,771,218 | A | 9/1988 | McGee | |
| 4,800,769 | A | 1/1989 | Rietsch | |
| 4,831,509 | A | 5/1989 | Jones et al. | |
| 4,852,706 | A | 8/1989 | Pietrzak et al. | |
| 4,855,653 | A | 8/1989 | Lemirande | |
| 4,860,813 | A * | 8/1989 | Ballyns et al. | 160/188 |
| 4,866,881 | A | 9/1989 | Morrow et al. | |
| 4,882,806 | A | 11/1989 | Davis | |
| 4,884,831 | A | 12/1989 | Emon | |
| 4,893,557 | A * | 1/1990 | Benthake et al. | 101/141 |
| 4,941,320 | A | 7/1990 | Kersten et al. | |
| 4,954,810 | A | 9/1990 | Llewellyn | |
| 4,976,168 | A | 12/1990 | Lotznicker et al. | |
| 4,979,553 | A | 12/1990 | Lowry, III et al. | |
| 4,993,470 | A * | 2/1991 | Ballyns et al. | 160/193 |
| 4,993,533 | A | 2/1991 | Brown | |
| 4,994,724 | A | 2/1991 | Hsu | |
| 5,025,591 | A | 6/1991 | DeLand et al. | |
| 5,029,057 | A | 7/1991 | Devir et al. | |
| 5,036,899 | A | 8/1991 | Mullet | |
| 5,083,600 | A | 1/1992 | Weishar et al. | |
| 5,139,075 | A | 8/1992 | Desrochers | |
| 5,153,560 | A | 10/1992 | Ichikawa | |
| 5,213,005 | A | 5/1993 | Nagano | |
| 5,218,282 | A | 6/1993 | Duhame | |
| 5,233,185 | A | 8/1993 | Whitaker | |
| 5,259,143 | A | 11/1993 | Mitchell et al. | |
| 5,278,480 | A | 1/1994 | Murray | |
| 5,282,337 | A | 2/1994 | Duhame et al. | |
| 5,357,183 | A | 10/1994 | Lin | |
| 5,408,724 | A | 4/1995 | Mullet et al. | |
| 5,409,051 | A | 4/1995 | Mullet et al. | |
| 5,419,010 | A | 5/1995 | Mullet | |
| 5,467,266 | A | 11/1995 | Jacobs et al. | |
| 5,481,076 | A | 1/1996 | Mullet et al. | |
| 5,494,093 | A | 2/1996 | Eiterman | |
| 5,495,640 | A | 3/1996 | Mullet et al. | |
| 5,509,233 | A | 4/1996 | Peterson | |
| 5,522,446 | A | 6/1996 | Mullet et al. | |
| 5,538,205 | A | 7/1996 | Bitson | |
| 5,557,887 | A | 9/1996 | Fellows et al. | |
| 5,560,432 | A | 10/1996 | Cante | |
| 5,562,141 | A | 10/1996 | Mullet et al. | |
| 5,566,740 | A | 10/1996 | Mullet et al. | |
| 5,568,672 | A | 10/1996 | Mullet et al. | |
| 5,581,939 | A | 12/1996 | Regan et al. | |
| 5,584,331 | A | 12/1996 | Lin | |
| 5,584,341 | A | 12/1996 | Sabin et al. | |
| 5,585,702 | A | 12/1996 | Jackson et al. | |
| 5,587,565 | A | 12/1996 | Schroder-Brumloop et al. | |
| 5,596,840 | A | 1/1997 | Teich | |
| 5,632,063 | A | 5/1997 | Carper et al. | |
| 5,636,678 | A | 6/1997 | Carper et al. | |
| 5,698,073 | A | 12/1997 | Vincenzi | |
| 5,704,707 | A | 1/1998 | Gebelein et al. | |
| 5,712,615 | A | 1/1998 | Maffey et al. | |
| 5,718,533 | A | 2/1998 | Mullet et al. | |
| 5,720,142 | A | 2/1998 | Morrison | |
| 5,740,630 | A | 4/1998 | Medebach | |
| 5,743,046 | A | 4/1998 | Siegler et al. | |
| 5,751,224 | A | 5/1998 | Fitzgibbon | |
| 5,793,300 | A | 8/1998 | Suman et al. | |
| 5,803,149 | A | 9/1998 | Halley et al. | |
| 5,822,922 | A | 10/1998 | Grumm et al. | |
| 5,836,499 | A | 11/1998 | Mullet et al. | |
| 5,855,093 | A | 1/1999 | Medebach | |
| 5,865,235 | A | 2/1999 | Krupke et al. | |
| 5,914,078 | A | 6/1999 | Morrison | |
| 5,929,580 | A | 7/1999 | Mullet et al. | |
| 5,931,212 | A | 8/1999 | Mullet et al. | |
| 5,975,185 | A | 11/1999 | Miller et al. | |
| 6,002,217 | A | 12/1999 | Stevens et al. | |
| 6,019,269 | A | 2/2000 | Mullet et al. | |
| 6,041,843 | A | 3/2000 | Mullet | |
| 6,055,885 | A | 5/2000 | Shea | |
| 6,078,249 | A | 6/2000 | Slavik et al. | |
| 6,089,304 | A | 7/2000 | Mullet et al. | |
| 6,092,582 | A | 7/2000 | Liu | |
| 6,098,910 | A | 8/2000 | Slezak | |
| 6,112,799 | A | 9/2000 | Mullet et al. | |
| 6,145,570 | A | 11/2000 | Mullet et al. | |
| 6,161,438 | A | 12/2000 | Mullet et al. | |
| 6,164,014 | A | 12/2000 | McDowell et al. | |
| 6,179,036 | B1 | 1/2001 | Harvey | |
| 6,196,705 | B1 | 3/2001 | Finke et al. | |
| 6,253,824 | B1 | 7/2001 | Mullet et al. | |
| 6,257,305 | B1 | 7/2001 | Mullet et al. | |
| 6,263,947 | B1 | 7/2001 | Mullet | |
| 6,296,039 | B1 | 10/2001 | Mullet et al. | |
| 6,325,134 | B1 | 12/2001 | Mullet | |
| 6,326,751 | B1 | 12/2001 | Mullet et al. | |
| 6,326,754 | B1 | 12/2001 | Mullet | |
| 6,341,639 | B1 | 1/2002 | Mullet et al. | |
| 6,374,543 | B1 | 4/2002 | Bishai | |
| 6,374,567 | B1 | 4/2002 | Mullet | |
| 6,378,593 | B1 | 4/2002 | Mullet et al. | |
| 6,401,792 | B1 * | 6/2002 | Mullet et al. | 160/188 |
| 6,431,250 | B2 | 8/2002 | Mullet et al. | |
| 6,442,897 | B1 | 9/2002 | Mullet | |
| 6,463,988 | B1 | 10/2002 | Mullet et al. | |
| 6,523,596 | B1 | 2/2003 | Mullet et al. | |
| 6,527,035 | B2 | 3/2003 | Hoffard et al. | |
| 6,527,037 | B2 | 3/2003 | Daus et al. | |
| 6,554,047 | B1 | 4/2003 | Mondragon et al. | |
| 6,561,255 | B1 | 5/2003 | Mullet | |
| 6,561,256 | B2 * | 5/2003 | Mullet | 160/191 |
| 6,568,454 | B1 | 5/2003 | Mullet et al. | |
| 6,588,156 | B2 | 7/2003 | Mullet | |
| 6,604,593 | B1 | 8/2003 | Mullet | |
| 6,605,910 | B2 | 8/2003 | Mullet et al. | |
| 6,611,205 | B2 | 8/2003 | Guthrie et al. | |
| 6,640,494 | B2 | 11/2003 | Horman | |
| 6,640,496 | B2 | 11/2003 | Mullet | |
| 6,640,872 | B1 | 11/2003 | Mullet | |
| 6,644,378 | B2 | 11/2003 | Mitchell | |
| 6,655,088 | B1 | 12/2003 | Horman | |
| 6,667,591 | B2 | 12/2003 | Mullet et al. | |
| 6,672,362 | B1 | 1/2004 | Mullet et al. | |
| 6,696,806 | B2 | 2/2004 | Study et al. | |
| 6,698,558 | B1 | 3/2004 | Caraballo | |
| 6,715,236 | B2 | 4/2004 | Mullet | |
| 6,725,898 | B2 | 4/2004 | Mullet et al. | |
| 6,733,413 | B2 | 5/2004 | Lagarde et al. | |
| 6,739,372 | B2 | 5/2004 | Mullet et al. | |
| 6,741,052 | B2 | 5/2004 | Fitzgibbon | |

6,745,814 B2 6/2004 Hoofard et al.
6,782,662 B2 8/2004 McCartney et al.
6,796,357 B2 9/2004 Kirby
6,824,637 B2 11/2004 Mullet et al.
6,843,300 B2 1/2005 Mullet et al.
6,845,804 B2 1/2005 Mullet
6,848,556 B2 2/2005 Chen et al.
6,851,464 B2 2/2005 Hudoba et al.
6,851,465 B2 2/2005 Mullet et al.
6,873,127 B2 3/2005 Murray
6,880,609 B2 4/2005 Mullet et al.
6,883,579 B2 4/2005 Olmsted
6,886,300 B2 5/2005 Hudoba et al.
6,897,630 B2 5/2005 Murray et al.
6,899,157 B2 5/2005 Mullet
6,903,650 B2 6/2005 Murray
6,907,964 B2 6/2005 Savard
6,918,211 B2 7/2005 Nakano
6,926,061 B2 8/2005 Schulte
6,943,515 B2 9/2005 Kidokoro
6,951,237 B2 10/2005 Mullet
6,953,074 B2 10/2005 Cardinal
6,955,206 B2 10/2005 Mullet et al.
6,959,748 B2 11/2005 Hudoba
6,963,267 B2 11/2005 Murray
6,981,538 B2 1/2006 English
6,986,378 B2 1/2006 Beaudoin et al.
6,989,767 B2 1/2006 Fitzgibbon et al.
7,014,386 B1 3/2006 Mullet et al.
7,017,302 B2 3/2006 Brookbank et al.
7,036,548 B2 5/2006 Johnston et al.
7,038,409 B1 5/2006 Mullet
7,053,571 B1 5/2006 Van Drunen et al.
7,055,571 B2 6/2006 Johnston et al.
7,059,380 B2 6/2006 Bennett, III et al.
7,061,197 B1 * 6/2006 Mullet et al. ..... 318/466
7,075,256 B2 7/2006 Murray
7,109,677 B1 9/2006 Gagnon et al.
7,114,753 B2 10/2006 Nodorft
7,116,072 B1 10/2006 Murray et al.
7,117,916 B2 10/2006 Johnston et al.
7,121,317 B2 10/2006 Mullet
7,123,128 B2 10/2006 Mullet et al.
7,127,847 B2 10/2006 Fitzgibbon et al.
7,128,123 B2 10/2006 Mullet et al.
7,134,471 B2 11/2006 Bennett, III et al.
7,134,472 B2 11/2006 Bennett, III et al.
7,143,804 B2 12/2006 Mullet et al.
7,144,051 B2 12/2006 Gillingham et al.
7,146,765 B2 12/2006 Sanke et al.
7,173,389 B1 2/2007 Gagnon
7,173,514 B2 2/2007 Mullet et al.
7,173,516 B2 2/2007 Mullet et al.
7,174,673 B2 2/2007 Sanke et al.
7,176,647 B2 2/2007 Parsadayan et al.
7,183,732 B2 2/2007 Murray
7,190,266 B2 3/2007 Mullet et al.
7,205,735 B2 4/2007 Keller et al.
7,207,142 B2 4/2007 Mullet
7,211,975 B2 5/2007 Murray et al.
7,219,392 B2 5/2007 Mullet et al.
7,228,883 B1 6/2007 Murray
7,246,647 B2 7/2007 Mullet et al.
7,248,144 B2 7/2007 Rodriguez
7,254,868 B2 8/2007 Mullet et al.
7,265,508 B1 9/2007 Karasek et al.
7,266,344 B2 9/2007 Rodriguez
7,270,029 B1 9/2007 Papanikolaou et al.
7,289,014 B2 10/2007 Mullet et al.
7,310,043 B2 12/2007 Mamaloukas
2007/0215292 A1 * 9/2007 Mullet ..... 160/189

* cited by examiner

APPARATUS FOR OPENING AND CLOSING OVERHEAD SECTIONAL DOORS

TECHNICAL FIELD

The embodiments disclosed herein relate to apparatus for opening and closing doors, and in particular to motorized apparatus for opening and closing overhead sectional doors.

INTRODUCTION

Overhead panel or sectional doors have been used as doors in various applications for many years, including industrial workspaces and garages in homes. Over the years, various types of manual and automatic opening and closing devices have been developed.

For example, U.S. Pat. No. 4,191,237 (Voege) describes a garage door opener for simple installation and to fully actuate various counterbalanced doors of different makes with minimum mechanism, and to be packaged and sold as a compact kit. The opener is built around a short main drive shaft adapted to be coupled coaxially to the end of the door counterbalance shaft. The drive shaft is journalled in two frame side members and therebetween carries a worm gear and two friction drive disks spring-pressed against the gear to transmit limited drive torque therefrom to the shaft. The gear is driven by a worm on the shaft of a motor on a carrier which is slidable on the frame. A manual cam moves the carrier between a worm-engaged position for drive and a worm-disengaged position to release the door for manual operation. A threaded extension of the main shaft carries a pair of traveling nuts which actuate switches to limit door travel both directions. In one modification, the assembly is mounted on studs on a mounting plate and adjusted thereto to bring the drive shaft coaxial with the counterbalance shaft, and the two shafts are coupled. In a second modification, the assembly is cantilevered by its drive shaft on the counterbalance shaft and is stabilized in coaxial relation therewith by a torque-reaction bracket. Such bracket may include a torque-limiting switch operable to reverse the drive in response to excess torque. For most installations, a down-drive cable is added to the counter-balance mechanism and connected to positively move the door from open to closed position in response to down-drive rotation of the counterbalance shaft.

Furthermore, U.S. Pat. No. 5,931,212 (Mullet et al.) describes an operating system for controllably moving in upward and downward directions a sectional door in relation to a door frame having a pair of jambs and an interconnecting header, including a counterbalancing system having a drive tube interconnected with the sectional door proximate the ends thereof, a motorized operator mounted adjacent to the drive tube and between the ends of the sectional door, and a drive train interconnecting the drive tube and the motorized operator for selectively driving the sectional door in upward and downward directions. The operator includes a motor for selectively rotating a drive shaft in two directions, a drive wheel on the drive shaft for rotating the drive train in one direction when the motor rotates the drive shaft in one direction, and a coupler on the drive shaft rotating the drive wheel when located in a first position and directly engaging and rotating the drive gear in the other direction when located in a second position.

Finally, U.S. Pat. No. 6,739,372 (Mullet et al.) describes a system for raising and lowering a sectional overhead door between an open position and a closed position including a counterbalance system adapted to be connected to the door, an operator motor assembly mounted proximate to the sectional overhead door in the closed position of the sectional overhead door, at least a portion of the operator motor assembly movable between a door operating position and a door locking position, and a locking assembly having an engaged position to hold the motor assembly in the operating position and a disengaged position to release the motor assembly allowing it to move to the door locking position. The system may be provided with a remote light assembly having a switchable light source in sensing communication with the operator motor such that operation of the motor activates the light source. The system is further provided with a handle assembly operatively engaging the motor assembly and counterbalance system to selectively disconnect the motor assembly from the counterbalance system, whereby urging of a rotatable handle to a disconnect position allows the door to be manually freely movable with the aid of the counterbalance system.

However, the inventors have identified a need for an improved apparatus for opening and closing overhead sectional doors.

SUMMARY

According to one aspect, there is provided an apparatus for opening and closing an overhead door, comprising: a door assembly for mounting to the overhead door; and an operator for securely engaging the door assembly, the operator having a chassis, and a cable reel rotatably mounted to the chassis and coupled to a main cable; wherein, when the main cable is coupled to the door assembly, as the cable reel is rotated in a first direction, the door assembly is drawn towards the operator so as to close the door.

The apparatus may further comprise a latch assembly for securing the door assembly to the operator when the door is closed; and a latch release mechanism for selectively disengaging the latch assembly so as to disengage the door assembly from the operator. The latch release mechanism may be a latch release wheel.

The overhead may be biased to the open position so that when the latch assembly is disengaged, the overhead door automatically opens.

The apparatus may further comprise a shuttle assembly rotatably mounted to the chassis between the cable reel and the latch release wheel. The shuttle assembly may be movable along a linear axis into a first engaged position wherein the shuttle assembly engages the cable reel so that rotation of the shuttle assembly in a first direction causes the cable reel to wind up the main cable to pull the door assembly towards the operator. The shuttle assembly may be movable along the linear axis between the first engaged position and a second engaged position wherein the shuttle assembly engages the latch release wheel so that rotation of the shuttle assembly in a second direction rotates the latch release wheel to open the latch assembly to disengage the door assembly from the operator.

The shuttle assembly may include first and second clutch members on opposite ends thereof, the cable reel may includes a third clutch member configured to face the first clutch member on the shuttle assembly, and the latch release wheel may include a fourth clutch member configured to face the second clutch member on the shuttle assembly, wherein, when the shuttle assembly is in the first engaged position, the first and third clutch members are engaged, and when the shuttle assembly is in the second engaged position, the second and fourth clutch members are engaged.

The first and third clutch members may be sized and shaped so that, when the shuttle assembly is in the first engaged position, rotation of the shuttle assembly in the second direction causes the first and third clutches to disengage and causes the shuttle assembly to move along the linear axis towards the second engaged position.

The second and fourth clutch members may be sized and shaped so that, when the shuttle assembly is in the second engaged position, rotation of the shuttle assembly in the first direction causes the second and fourth clutch members to disengage and causes the shuttle assembly to move along the linear axis towards the first engaged position.

Engaging surfaces of the first and second clutch members may be spaced apart by a first distance, and engaging surfaces of the second and fourth clutch members may be spaced apart by a second distance greater than the first distance.

The first and second distances may be selected so that only one pair of opposing clutch members may be engaged simultaneously.

The first and second distances may be selected so that one of the pairs of clutch members is always engaged.

Each clutch member may be shaped as a toothed wheel having a plurality of teeth spaced in a radial pattern.

The door assembly includes a first subassembly having a latch pin, and the latch assembly includes a latch in the chassis sized and shaped for receiving the latch pin therein. The first subassembly may include two adjustable plates that are adjustable so that the latch pin can be repositioned with respect to the door assembly. The first subassembly may be affixed to an elongate shaft, and further comprising a second subassembly coupled to the first subassembly via the shaft.

The second subassembly may comprise a tracking hinge rotatably coupled to the shaft and having an idler wheel coupled thereto, the idler wheel configured to be received in a track member adjacent the door; a tab rigidly coupled to the shaft and having a first end that extends so as to engage the tracking hinge; and a biasing member configured to bias the tracking hinge and tab together.

The spring, tracking hinge, and tab may cooperate so that the first subassembly generally follows the movement of the tracking hinge in the tracks as the door is opened and closed.

The tracking hinge, tab and spring may be sized and shaped such that, when the door is closed, the main cable can pull the first subassembly towards the operator, causing the tab to pivot against the biasing force of the spring, so that the latch pin engages with the latch in the chassis.

The apparatus may further comprise a spring cup coupled to the cable reel, the spring cup having biasing element configured to keep the main cable securely wound around the cable reel.

The apparatus may further comprise a motor coupled to the shuttle assembly so as to selectively cause rotation of the shuttle assembly in either the first direction or the second direction.

BRIEF DESCRIPTION OF THE DRAWINGS

The drawings included herewith are for illustrating various examples of methods and apparatus of the present specification and are not intended to limit the scope of what is taught in any way. In the drawings.

DETAILED DESCRIPTION

Figure 1:
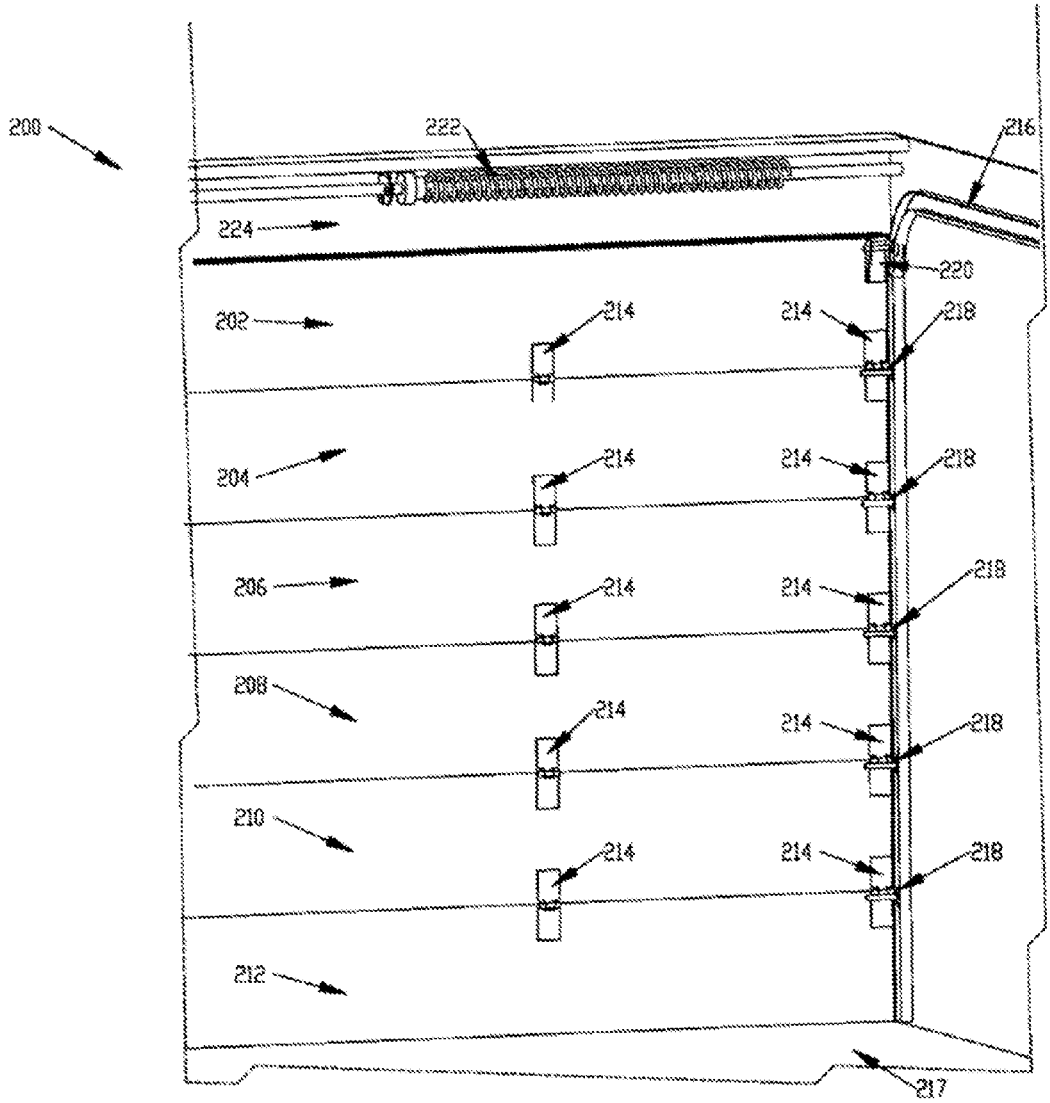
Fig. 1 (Prior Art)
FIG. 1 is an interior view of an example overhead sectional door.

Illustrated in FIG. 1 is an exemplary overhead sectional door 200 shown in a closed configuration. The overhead sectional door 200 includes a plurality of generally horizontal sections or panels 202, 204, 206, 208, 210, 212 that are coupled together using hinges 214.

Provided adjacent the ends of the panels 202, 204, 206, 208, 210, 212 are tracks 216 that generally extend vertical upwards from a floor 217 (e.g. the floor of a building or vehicle where the door 200 is located), and then curve and run horizontal generally near top of the door 200 (e.g. above the uppermost panel 202 when the door 200 is closed).

As shown, the door 200 can also include wheel assemblies 218 extending outwardly from the edges of the panels 202, 204, 206, 208, 210, 212 and which may be coupled to the hinges 214 (or as separate assemblies 220). The wheel assemblies 218 have idler wheels that can be received in the tracks 216, and can guide the panels 202, 204, 206, 208, 210, 212 as the door 200 is opened and closed to ensure that the panels 202, 204, 206, 208, 210, 212 generally follow the path of the tracks 216, moving between a vertical orientation (as shown in FIG. 1) and an elevated horizontal orientation when the door 200 is open (not shown).

In some embodiments, the door 200 may also include one or more torsion springs 222 mounted (e.g. on a wall surface 224 or on a ceiling) above the door 200. Each torsion spring 222 is configured to counterbalance at least some of the weight of the door 200 so that the door 200 can be opened and/or closed more easily.

Figure 2:
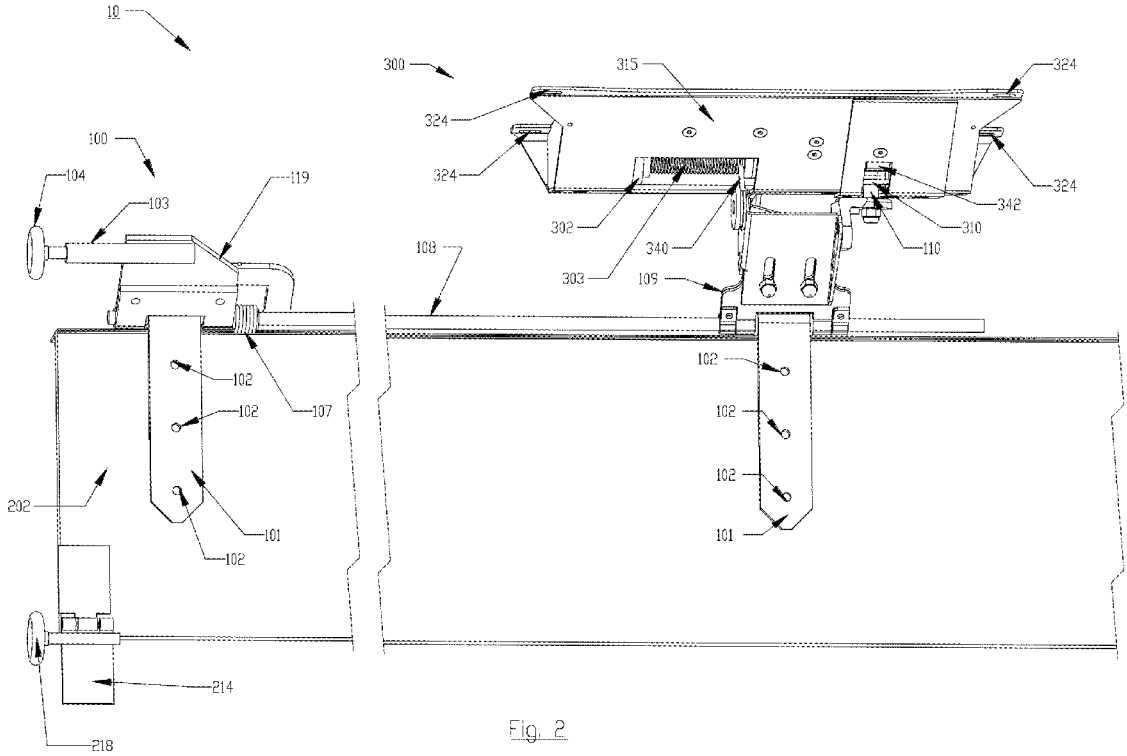
FIG. 2 is a perspective view of an apparatus for opening and closing an overhead sectional door according to one embodiment.

Turning now to FIG. 2, illustrated therein is an apparatus 10 for opening and closing an overhead sectional door, such as the door 200 shown in FIG. 1, according to one embodiment. The apparatus 10 generally includes a door assembly 100 configured to be coupled to the door 200, and an operator 300 configured to be coupled to the door assembly 100 for opening and closing the door 200.

Figure 3:
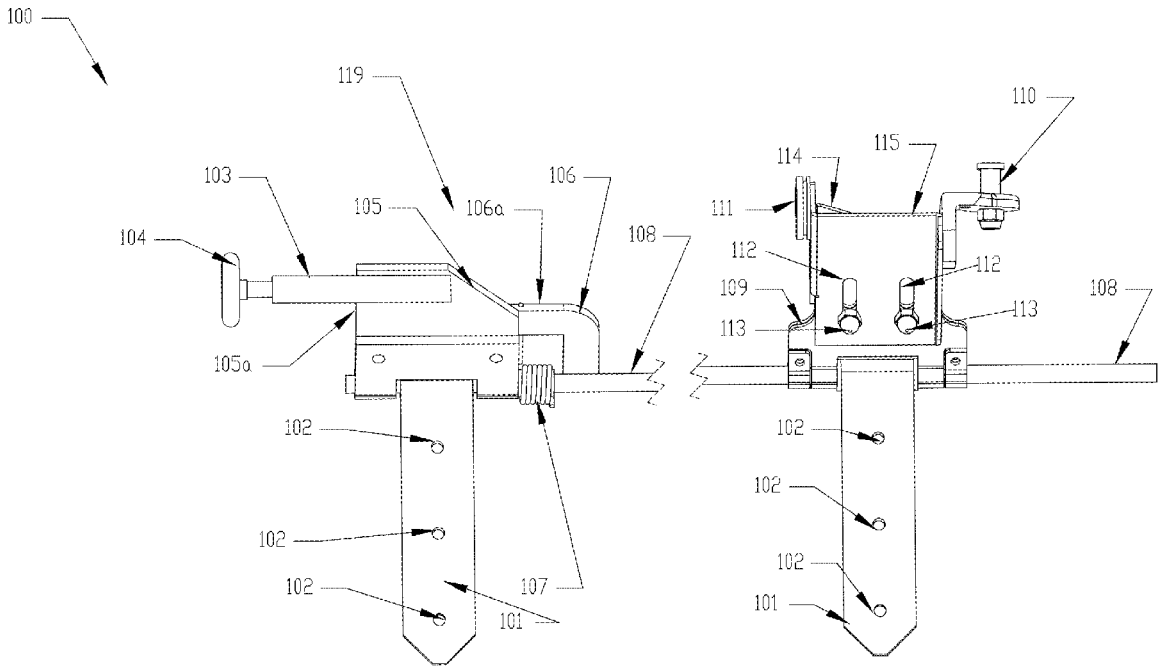
FIG. 3 is a perspective view of the door assembly of the apparatus of FIG. 2.

As shown in FIGS. 2 and 3, the door assembly 100 can include one or more hinges 101 for fastening the door assembly 100 to the uppermost panel 202 of the door 200 (e.g. using fasteners such as screws or nails received in apertures 102 in the hinges 101).

As shown, the door assembly 100 also includes an elongate shaft 108 that extends along at least a portion of the uppermost panel 202 of the door 200. The hinges 101 are coupled to the shaft 108 but are generally free to rotate so that the door assembly 100 and the uppermost door panel 202 can pivot with respect to each other.

Generally, the shaft 108 connects a first subassembly 109 of the door assembly 100 to a second subassembly 119 of the door assembly 100, as will be described in further detail below.

The first subassembly 109 generally includes a latch pin 110 or other latch member that protrudes outwardly therefrom, and a cable perch 111. The latch pin 110 is sized and shaped for engaging with a latch 310 or other latch-receiving member in the operator 300 for securing the door assembly 100 to the operator 300. Together the latch pin 110 and latch 310 generally define a latch assembly for securing or locking the door assembly 100 to the operator 300.

In some embodiments, the first subassembly 109 may be angularly adjustable (e.g. using fasteners such as bolts or screws to clamp the subassembly 109 to the shaft 108) so that the angular orientation of the subassembly 109 with respect to the shaft 108 may be modified. This may help provide for a desired alignment between the latch pin 110 and the latch 310 to ensure proper coupling therebetween. For example, when the door assembly 100 is first mounted on the door 200, the latch pin 110 can be engaged with the latch 310 with the first subassembly 109 loosely held on the shaft 108, and then the first subassembly 109 can be clamped to the shaft 108 at a suitable angle.

As shown, in some embodiments, the first subassembly 109 may include two adjustable plate members 114, 115 secured together using one or more fasteners 113 and one or more slots 112. For example, the first plate member 114 may be clamped to the shaft 108, while the latch pin 110 is provided on the second plate member 115. By adjusting the fasteners 113 in the slots 112, the position of the second plate member 115 can be adjusted relative to the first plate member 114 so that the latch pin 110 can be repositioned with respect to the door assembly 100. This may further facilitate obtaining proper latching between the latch pin 110 and the latch 310, particularly where the distance between the top of the door 200 and the operator 300 may vary.

As shown in FIG. 2, the cable perch 111 can be coupled to a main cable 340 for use in selectively closing the door 200, as will be described in further detail below.

The second subassembly 119, on the other hand, may include a tab 106 that is rigidly fixed to the shaft 108 (e.g. by welding or other techniques), and a tracking hinge 105 mounted to the shaft 108 and free to rotate with respect to the shaft 108.

As shown, the tracking hinge 105 has a pin member 103 that protrudes outwardly beyond its outer edge 105*a*, and has an idler wheel 104 mounted thereto. The idler wheel 104 is configured to ride in the track 216 during use so that the tracking hinge 105 follows the path of the track 216 as the door 200 is opened and closed.

As shown in FIG. 3, the tab 106 has a first end 106*a* that extends outwardly to interfere with and inhibit rotation of the tracking hinge 105 around the shaft 108. The tracking hinge 105 and tab 106 may also be biased towards each other by a spring 107 or other biasing member.

The spring 107, tracking hinge 105, first end 106*a* and the shaft 108 cooperate so that the first subassembly 109 generally follows the movement of the tracking hinge 105 as the door 200 is opened and closed, so as to avoid interference between the first subassembly 109 and the operator 300, and to track the movement of the door 200 (like an additional panel would), so it generally does not intrude into the cargo space.

Furthermore, the interaction between the tracking hinge 105, tab 106 and spring 107 allows the latch pin 110 to be received in the latch 310 as the door 200 is closed. In particular, after the door 200 is closed (e.g. when the lowermost panel 212 is engaged against the floor surface 217), the main cable 340 can be further tightened. This pulls the cable perch 111 towards the operator 300, causing the first subassembly 109 and tab 106 to pivot towards the operator 300 (generally away from the tracking hinge 105 against the biasing force of the spring 107), so that the latch pin 110 engages with the latch 310 through the latch opening 342. In this manner, the door assembly 100 can be locked to the operator 300.

In some embodiments, the door assembly 100 may be adjustable and may be used with doors 200 of different widths without the need for any customization of the door assembly 100.

Figure 4:
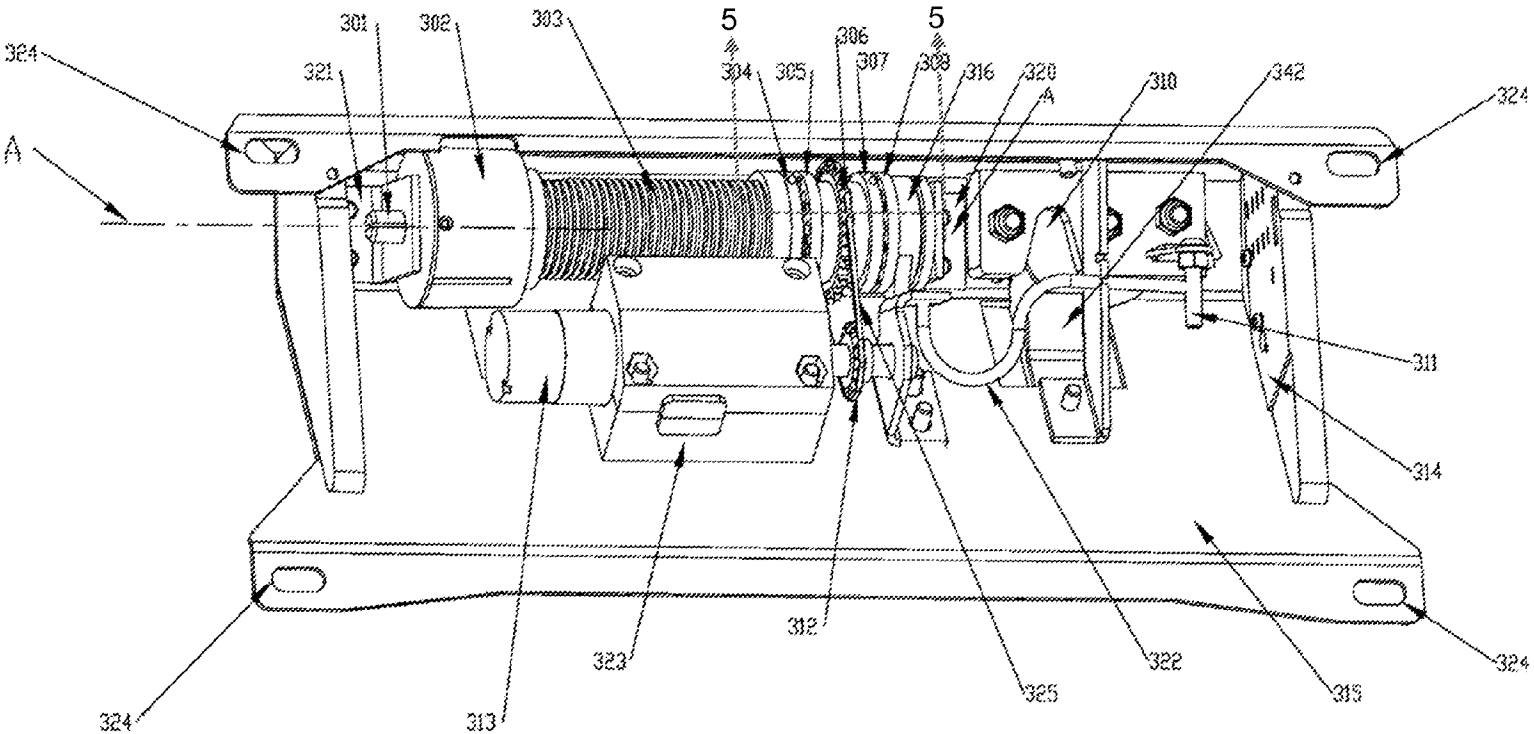
FIG. 4 is a perspective view of the operator of the apparatus of FIG. 2.

Turning now to FIG. 4, the operator 300 is shown in greater detail. The operator 300 generally includes an outer chassis 315 for mounting adjacent the door 200 for example, using fasteners coupled to apertures 324. In some embodiments, the operator 300 may be mounted on a wall above the door 200 (e.g. on the upper wall 224 of the vehicle or building in which the door 200 is installed). In other embodiments, the operator 300 may be mounted above the door 200 (e.g. on the ceiling of the vehicle of building in which the door 200 is installed).

In some embodiments, the chassis 315 may be sized and shaped to take up very little space, and so as to have a low profile. In particular, since the operator 300 may be positioned above the door 200 (e.g. on the wall 224 or on the ceiling), it may be sized and shaped so as not to interfere with overhead clearance between the door panels 202, 204, 206, 208, 210, 212 and the ceiling. This may be particularly advantageous when the apparatus 10 is used with doors 200 provided in vehicles (e.g. for retrofitting trucks, trailers, etc.) where space may be at a premium.

As shown, the operator 300 generally includes a shaft 301 rigidly fastened to the chassis 315 and extending along a linear axis A. Mounted on the shaft 301 are a spring cup 302 and a cable reel 303. Both the spring cup 302 and cable reel 303 are generally free to rotate about the main shaft 301.

The cable reel 303 is generally configured to wind up the main cable 340 when rotating in a first direction (e.g. a counterclockwise direction when looking along the main shaft 301 from the latch 310 end towards the spring cup 302 in the illustrated embodiment). For example, when the main cable 340 is attached to the cable perch 111 on the door assembly 100, rotating the cable reel 303 in the first direction winds the main cable 340 around the cable reel 303 and pulls the door assembly 100 towards to the operator 300, thus closing the door 200.

The spring cup 302 is generally coupled to the cable reel 303, and may include a biasing element (e.g. a motor spring) that operates between the main shaft 301 and the spring cup 302 so as to keep the main cable 340 securely wound around the cable reel 303 (e.g. with 5-10 lbs force, or greater or lesser force as desired depending on the size of the spring cup 302, cable reel 303 and main cable 340). This tends to inhibit the main cable 340 from becoming loose, which could result in the main cable 340 becoming entangled or otherwise interfering with the function of the operator 300.

The operator 300 also generally includes a latch release mechanism for releasing the latch pin 110 from the latch. For example, as shown in this embodiment, mounted on the shaft 301, generally at the opposite end from the spring cup 302, is a latch release wheel 316.

The latch release wheel 316 is connected to a latch release cable 322, which in turn is coupled to a latch release arm 311 that controls the latch 310. Generally, the latch release wheel 316 is configured to open the latch assembly so that the door assembly 100 may be unlocked from the operator 300. For example, the latch release wheel 316, cable 322, release arm 311 and latch 310 are configured so that when the latch release wheel 316 is rotated in a second direction (e.g. a clockwise direction looking along the main shaft 301 from the latch 310 end towards the spring cup 302), the latch release wheel 316 pulls on the cable 322, activating the release arm 311 and opening the latch 310 (thus releasing the latch pin 110 and unlocking the door assembly 100 from the operator 300).

In some embodiments, as shown, the latch release wheel 316 is mounted on the shaft 301 and may be driven by the motor 313 in the second direction (as will be described in greater detail below).

In other embodiments, the latch release wheel 316 may be coupled to another actuator (e.g. a second motor) that is configured to drive the latch release wheel 316 to disengage the latch assembly.

In yet other embodiments, the latch release mechanism may have another suitable configuration. For example, the release arm 311 may be coupled to and controlled by another actuator (e.g. an electrical or mechanical switch, for example a solenoid) that may be used to directly disengage the latch assembly without the use of a latch release wheel 316.

In some embodiments, the latch release cable 322 may be received in a guide member (e.g. a hollow tube) to help direct and protect the latch release cable 322.

Figure 5:
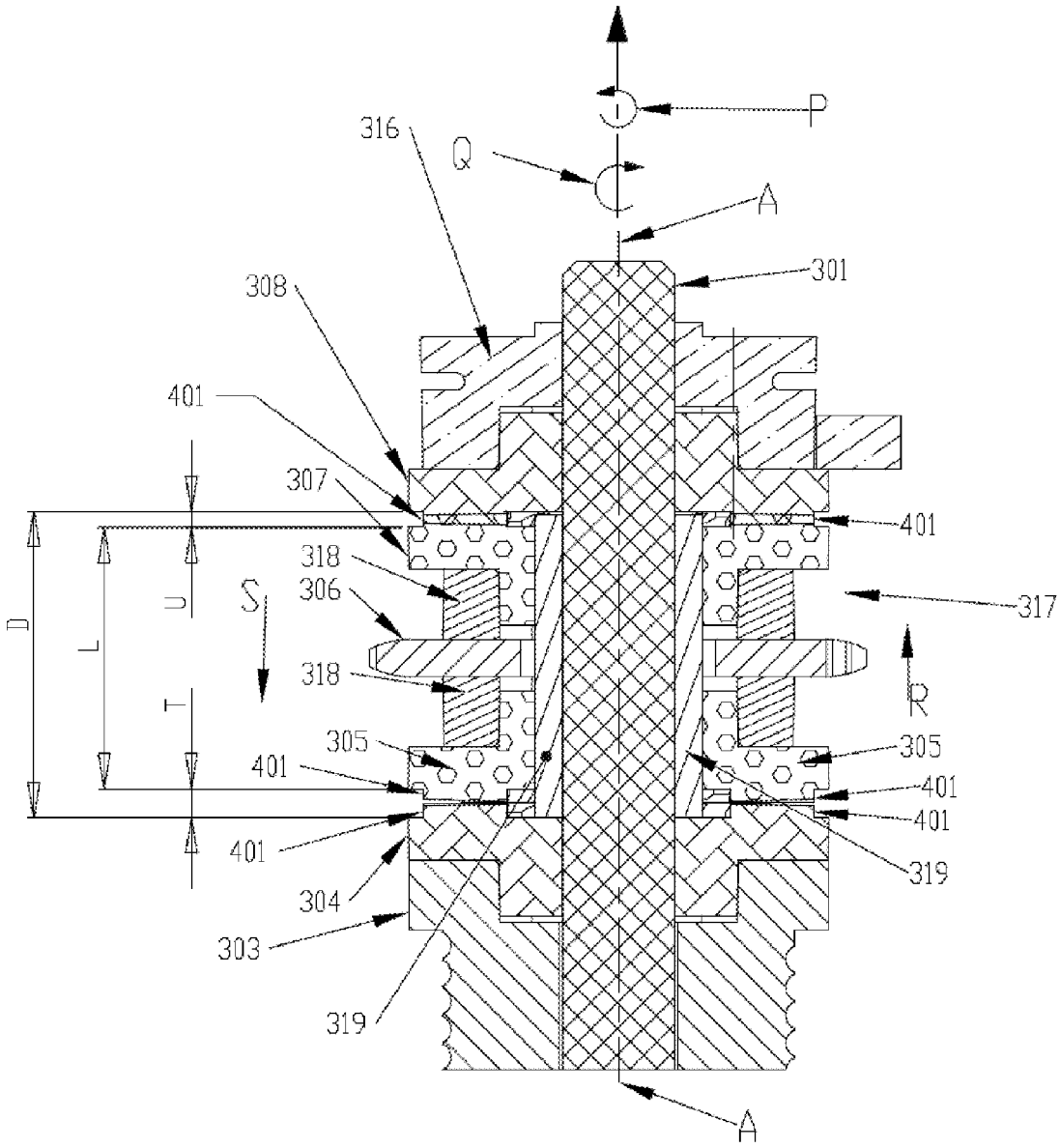
FIG. 5 is a partial cross-sectional view of the operator of FIG. 4.

As shown in FIG. 5, the operator 300 may also include a shuttle assembly 317 rotatably mounted on the main shaft 301, generally between the cable reel 303 and the latch release wheel 316. The shuttle assembly 317 is configured to be movable along the linear axis A between a first engaged position wherein the shuttle assembly 317 is engaged with the cable reel 303, and a second engaged position wherein the shuttle assembly is engaged with the latch release wheel 310. Generally, the shuttle assembly 317 will move between the first engaged position and the second engaged position depending on the direction of rotation of the shuttle assembly 317.

As shown, the shuttle assembly 317 includes a first clutch member 305 on a first side thereof, a second clutch member 307 on the opposite side thereof, a sprocket 306 between the clutch members 305, 307 configured to receive a chain 325 or another drive member, and a spacer 318 between the clutch members 305, 307 and being sized and shaped so that the engaging surfaces of the clutch members 305, 307 are spaced apart by a fixed first distance L.

As shown, a third clutch member 304 may be mounted to the cable reel 303 (and face the first clutch member 305), while a fourth clutch member 308 may be mounted to the latch release wheel 316 (and face the second clutch member 307).

With reference to FIG. 5, when the shuttle assembly 317 is in the first engaged position, the first and third clutches 305, 304 are engaged so that rotation of the shuttle assembly 317 in the first direction P causes rotation of the cable reel 303 in the first direction P (which winds the main cable 340 around the cable reel 303), while the second and fourth clutch members 307, 308 are disengaged.

Conversely, when the shuttle assembly 317 is in the second engaged position, the second and fourth clutch members 307, 308 are engaged so that rotation of the shuttle assembly 317 in the second direction Q causes rotation of the latch release wheel 316 in the second direction Q (which releases the latch 310) while the first and third clutch members 305, 304 are disengaged.

As shown, the clutch members 304, 305, 307, 308 are also configured so that, when the shuttle assembly 317 is in the first engaged position, rotation of the shuttle assembly 317 in the second direction Q causes the first and third clutches 305, 304 to disengage and the shuttle assembly 317 to move along the axial direction R and into the second engaged position.

Similarly, the clutch members 304, 305, 307, 308 are configured so that, when the shuttle assembly 317 is in the second engaged position, rotation of the shuttle assembly 317 in the first direction P causes the second and fourth clutch members 307, 308 to disengage and the shuttle assembly 317 to move along the axial direction S and into the first engaged position.

In this manner, by rotating the shuttle assembly 317 in either the first direction P or the second direction Q, the shuttle assembly 317 can be selectively moved along the linear axis A (e.g. in either axial direction R or S) between the first and second engaged positions so as to either close the door 200 or unlock the door assembly 100 from the operator 300.

As shown, the shuttle assembly 317 generally rotates around and slides along a shuttle sleeve 319 provided around the main shaft 301, with the shuttle sleeve 319 being free to rotate about the main shaft 301. The shuttle sleeve 319 generally keeps the third and fourth clutch members 304, 308 spaced apart by a minimum second distance D (and which is greater than the first distance L).

Generally, the first and second distances L, D are selected so that only one pair of opposing clutch members (e.g. 304 and 305, or 307 and 308) may be engaged simultaneously. For example, the second distance D may be selected relative to the first distance L so that when the first and third clutch members 305, 304 are engaged (e.g. when the shuttle assembly 317 is in the first engaged position), the other pair of clutch members 307, 308 are disengaged.

In some embodiments, the first and second distances L, D may be selected so that generally one of the pairs of clutch members is always engaged. For example, the second distance D may be selected relative to the first distance L so that one of the pairs of opposing clutch members (e.g. 304 and 305, or 307 and 308) is always engaged.

As shown, the first and third clutch members 305, 304 are separated by a first clutch distance T, while the second and fourth clutch members 307, 308 are separated by a second clutch distance U. The first and second clutch distances T, U will generally vary as the shuttle assembly 317 moves between the first engaged position and the second engaged position.

In some embodiments, a maximum distance between the third and fourth clutch members 304, 308 may be maintained by main shaft brackets 320, 321 provided at opposite ends of the shaft 301 (as shown in FIG. 4), and which may be biased inwardly towards each other so as to apply a compression force onto the components on the main shaft 301.

In some embodiments, a motor 313 (and in some cases a gearbox 323) may be used to drive the shuttle assembly 317 in either the first or second directions P, Q. For example, the output shaft of the motor 313 and gearbox 323 drives a drive sprocket 312, which is coupled to the sprocket 306 on the shuttle assembly 317 using the drive chain 325.

Generally, the drive chain 325 is sufficiently flexible to accommodate some lateral misalignment between sprocket 312 and sprocket 306, thereby allowing the shuttle assembly 317 to move laterally along the linear axis A between the first and second engaged positions.

In some embodiments, the sprockets 306, 312 and drive chain 325 may be replaced by a belt and pulley system. In yet other embodiments, a splined gear system may be used to couple the motor 313 to the shuttle assembly 317 generally without the use of sprockets and chains or pulleys and belts.

In some embodiments, the motor 313 may be a DC motor, for example a 12V or 24V DC motor. Such embodiments may be desirable, for example when the apparatus 10 is mounted on a vehicle having the door 200 thereon, and may allow the apparatus to run off of existing batteries that can be charged by a main power supply connected to a battery charger and which may be operational in a power outage. In other embodiments, the motor 313 may be an AC motor powered via an AC power supply, for example in a residence or business.

In some embodiments, the motor 313 of the apparatus 10 may be powered by solar cells, which may be useful for off-grid applications, such as in boat-houses and sheds.

In some embodiments, as shown, the motor 313 and gearbox 323 are generally parallel and adjacent the shaft 301 and the members coupled thereto. In other embodiments, one or more of the motor 313, gearbox 323, shaft 301 and various other components need not be parallel. For example, the drive sprocket 312 may angled with respect to the shaft 301 such that the top (or closest) portion of the drive sprocket 312 is aligned with the sprocket 306 when the shuttle assembly 317 is in the second engaged position, while the bottom (or distal) portion of the drive sprocket 312 is aligned with the sprocket 306 when the shuttle assembly 317 is in the first engaged position, as this may tend to assist the movement of the shuttle assembly 317.

As generally shown, when the motor 313 and gearbox 323 drive the drive sprocket 312 in the second direction Q, the shuttle assembly 317 also rotates in the second direction Q and moves in the axial direction R to the second engaged position, driving the latch release wheel 316 using the second and fourth clutch members 307, 308, releasing the latch 310 (and unlocking the door assembly 100 from the operator 300). As this happens, the first and third clutch members 304, 305 become disengaged, and the cable reel 303 becomes free to rotate. Thus, the main cable 340 may extend so that the door 200 can be opened.

In some embodiments, the torsion springs 222 may be suitably configured so that the door 200 is biased to open automatically when the latch 310 is disengaged and the main cable 340 is free to rotate (constrained by the spring in the spring cup 302). This may be particularly desirable, for example, if the operator 300 and/or door assembly 100 fail, in which case the door 200 will automatically open.

In other embodiments, other devices may be used to open the door 200 (e.g. a manual winch or other opening system, another motorized cable reel configured to pull the door open, etc.)

Alternatively, when the motor 313 and gearbox 323 drive the drive sprocket 312 in the first direction P, the shuttle assembly 317 also rotates in the first direction P and moves along the axial direction S and into the first engaged position, driving the cable reel 303 using the clutch members 304, 305, causing the main cable 340 to be wound around the cable reel 303. As this happens, the latch release wheel 316 is generally free to rotate about the main shaft 301 (constrained by the latch release cable 322). When the door 200 is closed, the main cable 340 can be further wound onto the cable reel 303 so as to pull the latch pin 110 to engage with the latch 310 through the latch opening 342.

Figure 6:
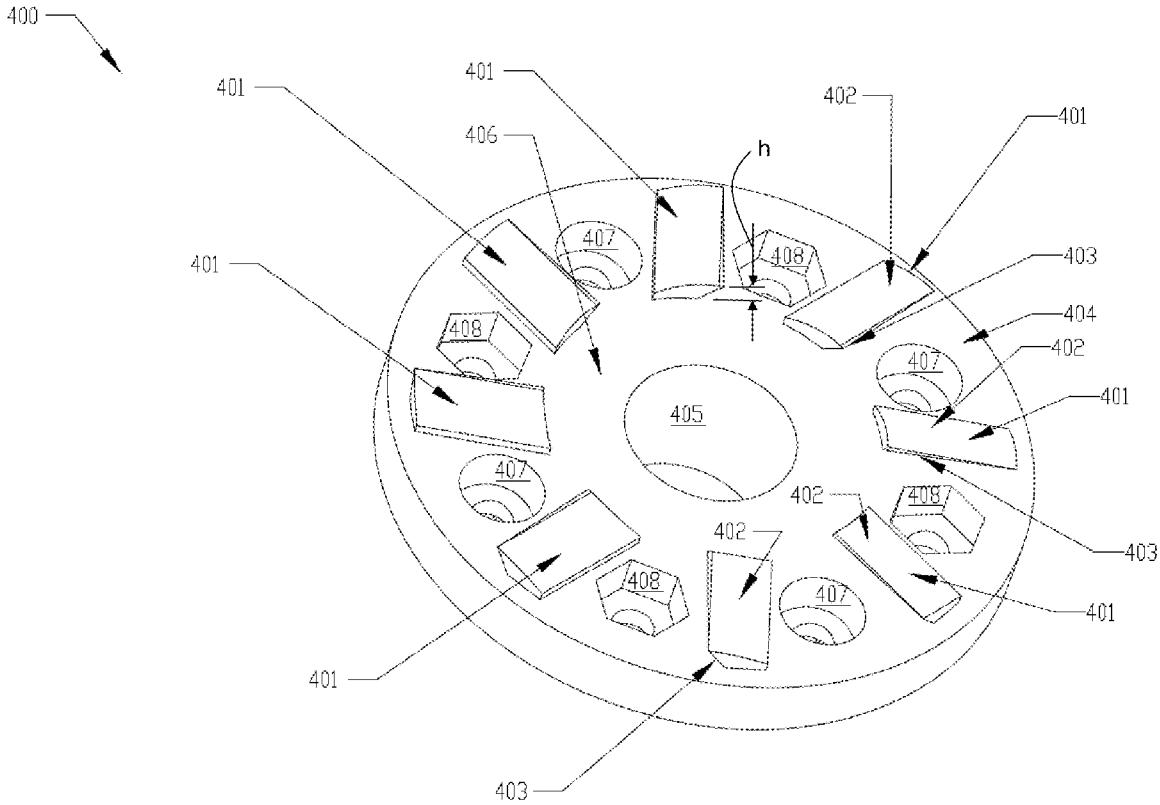
FIG. 6 is a perspective view of a toothed wheel for use as a clutch member in the operator of FIG. 4.

Turning now to FIG. 6, in some embodiments each clutch member 304, 305, 307, 308 may be shaped as a toothed wheel 400.

As shown, each wheel 400 is generally disc-shaped, with an engaging surface 406 having a plurality of teeth 401 spaced around the surface 406 in a radial pattern (in some case, with the teeth 401 adjacent the edge 404 of the wheel 400). For example, as shown a total of eight teeth 401 are provided on the engaging surface 406. In other embodiments, a greater or a lesser number of teeth may be provided on the engaging surface 406 of the wheel 400.

Each engaging surface 406 may be configured to engage with the engaging surface 406 of another wheel 400 during use. As shown, the teeth 401 are configured so that the teeth 401 on one wheel 400 can interlock with the teeth 401 on another wheel 400 when the wheels 400 rotate in a complementary direction (drawing the opposing engaging surfaces 406 together), but so that the teeth 401 push the opposing wheels 400 apart when rotated in the opposite direction (pushing the opposing engaging surfaces 406 apart).

For example, as shown each tooth 401 has an engaging first edge 403 and an angled back face 402. When the opposing engaging surfaces 406 of two wheels 400 are engaged and the wheels 400 rotated in a complementary direction (e.g. when the first and second clutches 305, 304 are rotated in the first direction P), the first edges 403 of the teeth 401 on the opposing wheels 400 mesh with each other so that the wheels 400 will rotate together and stay coupled.

However, when the same two wheels 400 are rotated in the opposite direction, then the back faces 402 of the teeth 401 on the opposing wheels 400 contact each other so as to push the two wheels 400 apart (via a wedging effect due to the slanted shape of the back faces 402).

Accordingly, when the clutches 304, 305, 307 and 308 are shaped as toothed wheels 400, the toothed wheels 400 can provide the desired motion of the shuttle assembly 317 between the first engaged position and the second engaged position depending on the rotational direction of the shuttle assembly 317.

As shown, each wheel 400 may include a central bore 405 through which the shaft 301 may be received. Each wheel 400 may include one or more circular apertures 407 and/or hexagonal apertures 408 provided about the surface. The apertures 407, 408 may be generally sized and shaped for receiving fasteners for coupling the wheel 400 to the cable reel 303, the latch release wheel 316, and onto the shuttle assembly 317.

In some embodiments, the teeth 401 extend outwardly from the surface 406 by a height h. In such embodiments, the first and second distances L, D may be selected such that the difference between them is equal to approximately three times the height h of the teeth 401. Furthermore, the first and second clutch distances T, U may have a minimum value equal to about the height h, and a maximum value equal to about two times the height h.

Generally, the apparatus 10 may be configured to operate in both automatic and manual modes.

For example, to automatically close the door 200 when the door 200 is open, the motor sprocket 312 can be rotated in the first direction P, causing the shuttle assembly 317 to engage with the cable reel 303 and wind the main cable 340 around the cable reel 303. This will tend to pull the door 200 closed as generally discussed above.

Generally, as the door 200 is closed, there are two stages. During the first stage, the door 200 is pulled downwards into the closed position by the main cable 340. Once the door 200 is closed, the main cable 340 can continue to be tightened so as to pull the latch pin 110 into engagement with the latch 310, so as to secure the door assembly 100 to the operator 300.

In some embodiments, the main cable 340 may be hidden by the door 200 when the door 200 is open, and the main cable 340 may be fully retracted onto the cable reel 303 when the door 200 is closed. In this manner, the main cable 340 may not be visible during normal operation of the door 200 and thus a cleaner aesthetic appearance may be provided.

In some embodiments, the current of the motor 313 can be monitored as the door 200 is closed. If the current exceeds a preset level for longer than some preset time, a determination can be made that the door 200 and/or the latch 110 has encountered an obstacle, which can trigger some further action (such as generating an alert, and/or stopping the winding of the cable reel 303 by deactivating the motor 313).

In some embodiments, this may be done by checking to see if the latch pin 110 is engaged in the latch 310 after a large current has been observed. If the latch pin 110 is engaged, then the door 200 is determined to be closed. However, if it the latch pin 110 is not engaged in the latch 310, then a determination is made that an obstacle has been encountered.

In some embodiments, further alerts can be generated based on the closing operation. For example, a alert signal may be generated when the door 200 is not properly stowed (e.g. when the latch pin 110 is not fully engaged in the primary latch position of latch 310), when the door 200 did not fully open, when the door 200 did not open or close within a predetermined time Alternatively, in some embodiments, the apparatus 10 may also be used to manually close the door 200. For example, a user may be able to pull the door 200 down as is conventionally the case (e.g. using a rope or chain, or simply by grabbing one of the door panels 202, 204, 206, 208, 210, 212), which may allow for opening of the door 200 in the absence of power, such as in the case of a system failure.

In some embodiments, manual operation of the door 200 does not engage the latch pin 110 in the latch 310, and thus manual operation may be unaffected by the addition of the automatic locking and unlocking features of the apparatus 10.

However, in other embodiments, once the door 200 is closed, the user may be able to manually engage the latch pin 110 with the latch 310, such as by using a manual actuator.

To automatically open an automatically closed door 200, the motor sprocket 312 can be rotated in the second direction Q, causing the shuttle assembly 317 to engage the latch release wheel 316, thus releasing the latch 310. The spring 107 then rotates the latch pin 110 and the first subassembly 109 away from the operator 300 so as to prevent interference between the door assembly 100 and the operator 300 as the door 200 closes, generally as described above. Once clear, in the embodiment as shown, the torsion springs 222 may be biased to open the door 200, or another device may be used to automatically open the door 200.

To manually open an automatically closed door, for example, a user may be able to pull on a manual latch release cable that is coupled to the latch release arm 311. This action pulls the latch release arm 311 and releases the latch 310. The spring 107 then rotates the latch pin 110 and the assembly 109 to prevent interference between the door assembly 100 and the operator 300, and the torsion spring 222 may automatically open the door 200.

In some embodiments, the manual latch release cable may be coupled to the frame of the structure (e.g. the building or vehicle to which the door 200 is mounted), as opposed to on a moving part of the door 200. This may be advantageous as the location of the manual latch release cable will tend to be stationary.

In some embodiments, the apparatus 10 may be controlled by one or more switches (e.g. a ON-OFF switch, a directional switch for the motor 313, etc.). In some embodiments, the apparatus 10 may also be controlled by a key fob or using other devices.

Figure 7:
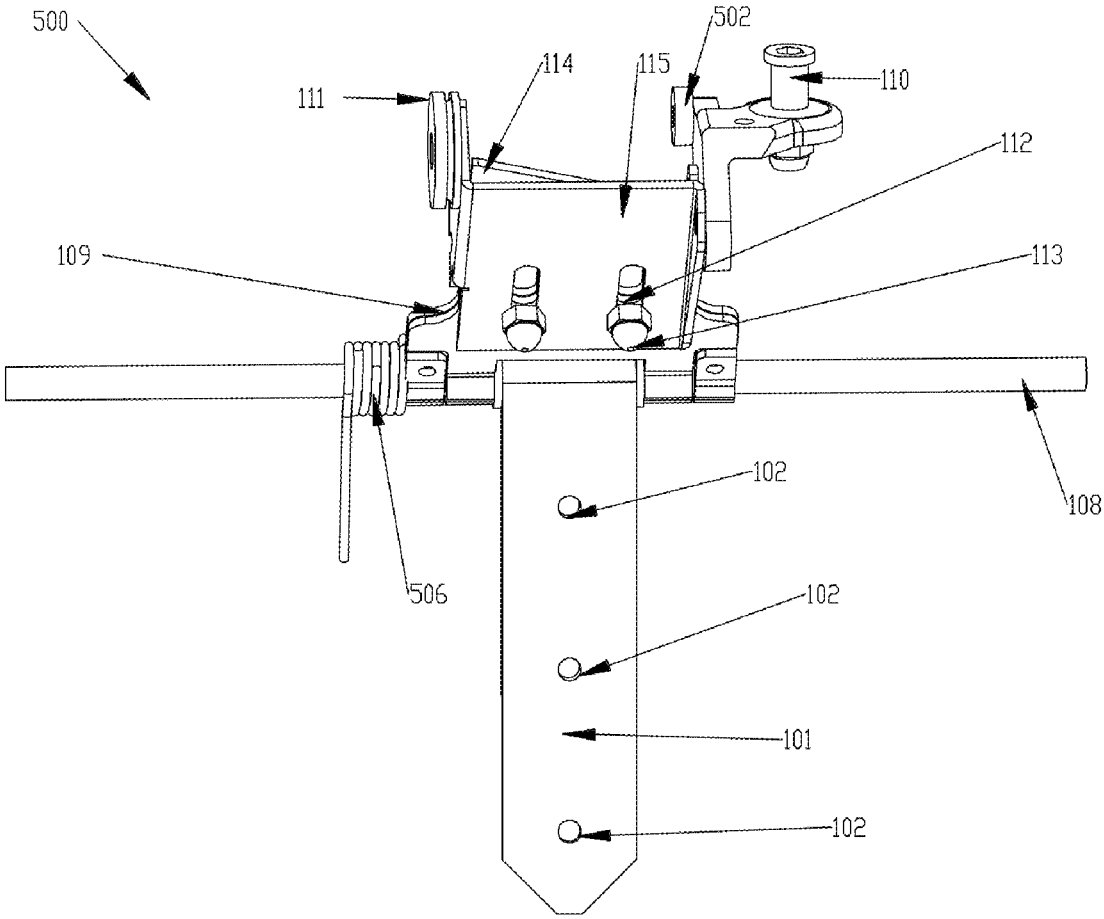
FIG. 7 is a perspective view of an apparatus for opening and closing an overhead sectional door according to another embodiment.

Turning now to FIG. 7, illustrated therein is an apparatus 500 for opening and closing an overhead sectional door according to another embodiment.

The apparatus 500 is generally similar to the apparatus 10 as described above, and similar elements are given similar reference numerals. In this embodiment, a roller 502 has been provided on the leading edge 504 of the first subassembly 109 that supports the latch pin 110. The roller 502 allows the latch pin 110 to more easily be received in the latch 310, and may help to reduce wear between the latch pin 110 and the latch 310.

Furthermore, in this embodiment the door assembly 100 may not include the second subassembly 119. Instead, the motion limiting function provided by subassembly 109, preferably located near the central region of the door assembly 100, may be provided by a spring 506 or other biasing member, an upper stop (not shown) a lower stop (not shown) and, if necessary for a particular installation, an extension of the chassis 324 which the roller 502 may contact. The spring 506 generally biases the latch pin down towards the lower mechanical stop, and the latch pin motion is constrained between these two mechanical stops. While the door is open, the upper and lower stop prevent assembly 109 from contacting the ceiling or intruding into the cargo area, respectively. As the door is nearly closed during the closing travel, the roller 502 contacts the chassis 324 and travels along the chassis 324 so as to encourage the latch pin 110 to engages with the latch 324.

While the above description provides examples of one or more methods and/or apparatuses, it will be appreciated that other methods and/or apparatuses may be within the scope of the present description as interpreted by one of skill in the art.

The invention claimed is:

1. An apparatus for opening and closing an overhead door, comprising:

a door assembly for mounting to the overhead door;

an operator for securely engaging the door assembly, the operator having a chassis, and a cable reel rotatably mounted to the chassis and coupled to a main cable;

wherein, when the main cable is coupled to the door assembly, as the cable reel is rotated in a first direction, the door assembly is drawn towards the operator so as to close the door;

a latch assembly for securing the door assembly to the operator when the door is closed;

a latch release mechanism for selectively disengaging the latch assembly so as to disengage the door assembly from the operator, wherein the latch release mechanism is a latch release wheel;

a shuttle assembly rotatably mounted to the chassis between the cable reel and the latch release wheel, wherein the shuttle assembly is movable along a linear axis into a first engaged position wherein the shuttle assembly engages the cable reel so that rotation of the shuttle assembly in a first direction causes the cable reel to wind up the main cable to pull the door assembly towards the operator; and the shuttle assembly is movable along the linear axis between the first engaged position and a second engaged position wherein the shuttle assembly engages the latch release wheel so that rotation of the shuttle assembly in a second direction rotates the latch release wheel to open the latch assembly to disengage the door assembly from the operator;

and wherein:

the shuttle assembly includes first and second clutch members on opposite ends thereof;

the cable reel includes a third clutch member configured to face the first clutch member on the shuttle assembly; and the latch release wheel includes a fourth clutch member configured to face the second clutch member on the shuttle assembly;

wherein, when the shuttle assembly is in the first engaged position, the first and third clutch members are engaged, and when the shuttle assembly is in the second engaged position, the second and fourth clutch members are engaged.

2. The apparatus of claim 1, wherein the first and third clutch members are sized and shaped so that, when the shuttle assembly is in the first engaged position, rotation of the shuttle assembly in the second direction causes the first and third clutches to disengage and causes the shuttle assembly to move along the linear axis towards the second engaged position.

3. The apparatus of claim 2, wherein the second and fourth clutch members are sized and shaped so that, when the shuttle assembly is in the second engaged position, rotation of the shuttle assembly in the first direction causes the second and fourth clutch members to disengage and causes the shuttle assembly to move along the linear axis towards the first engaged position.

4. The apparatus of claim 1, wherein engaging surfaces of the first and third clutch members are spaced apart by a first distance, and engaging surfaces of the second and fourth clutch members are spaced apart by a second distance greater than the first distance.

5. The apparatus of claim 4, wherein the first and second distances are selected so that only one pair of opposing clutch members may be engaged simultaneously.

6. The apparatus of claim 4, wherein the first and second distances are selected so that one of the pairs of clutch members is always engaged.

7. The apparatus of claim 1, wherein each clutch member is shaped as a toothed wheel having a plurality of teeth spaced in a radial pattern.

8. The apparatus of claim 1, further comprising a spring cup coupled to the cable reel, the spring cup having biasing element configured to keep the main cable securely wound around the cable reel.

9. The apparatus of claim 1, further comprising a motor coupled to the shuttle assembly so as to selectively cause rotation of the shuttle assembly in either the first direction or the second direction.

10. The apparatus of claim 1, wherein the overhead door is biased to the open position so that when the latch assembly is disengaged, the overhead door automatically opens.

11. The apparatus of claim 1, wherein the first subassembly is affixed to an elongate shaft, and further comprising a second subassembly coupled to the first subassembly via the shaft.

12. An apparatus for opening and closing an overhead door, comprising:

a door assembly for mounting to the overhead door;

an operator for securely engaging the door assembly, the operator having a chassis, and a cable reel rotatably mounted to the chassis and coupled to a main cable;

wherein, when the main cable is coupled to the door assembly, as the cable reel is rotated in a first direction, the door assembly is drawn towards the operator so as to close the door;

wherein the door assembly includes a first subassembly having a latch pin, and a latch assembly includes a latch in the chassis sized and shaped for receiving the latch pin therein;

wherein the first subassembly is affixed to an elongated shaft, and further comprising a second subassembly coupled to the first subassembly via the shaft wherein the second subassembly comprises:

a tracking hinge rotatably coupled to the shaft and having an idler wheel coupled thereto, the idler wheel configured to be received in a track member adjacent the door;

a tab rigidly coupled to the shaft and having a first end that extends so as to engage the tracking hinge; and a biasing member configured to bias the tracking hinge and tab together.

13. The apparatus of claim 12, wherein the biasing member, tracking hinge, and tab cooperate so that the first subassembly generally follows the movement of the tracking hinge in the tracks as the door is opened and closed.

14. The apparatus of claim 12, wherein the tracking hinge, tab and biasing member are sized and shaped such that, when the door is closed, the main cable can pull the first subassembly towards the operator, causing the tab to pivot against the biasing force of the spring, so that the latch pin engages with the latch in the chassis.

15. The apparatus of claim 12, further comprising a spring cup coupled to the cable reel, the spring cup having biasing element configured to keep the main cable securely wound around the cable reel.

16. The apparatus of claim 12, further comprising a motor coupled to the shuttle assembly so as to selectively cause rotation of the shuttle assembly in either the first direction or the second direction.

17. The apparatus of claim 12, wherein the overhead door is biased to the open position so that when the latch assembly is disengaged, the overhead door automatically opens.

* * * * *